US009023186B1

(12) United States Patent
Patibandla et al.

(10) Patent No.: US 9,023,186 B1
(45) Date of Patent: May 5, 2015

(54) HIGH PERFORMANCE TITANIA CAPACITOR WITH A SCALABLE PROCESSING METHOD

(75) Inventors: Nag B. Patibandla, Pleasanton, CA (US); Lu Yang, Milpitas, CA (US)

(73) Assignee: Applied Materials, Inc., Santa Clara, CA (US)

( * ) Notice: Subject to any disclaimer, the term of this patent is extended or adjusted under 35 U.S.C. 154(b) by 910 days.

(21) Appl. No.: 12/824,094

(22) Filed: Jun. 25, 2010

Related U.S. Application Data

(60) Provisional application No. 61/220,761, filed on Jun. 26, 2009.

(51) Int. Cl.
*C25D 5/02* (2006.01)
*H01L 21/288* (2006.01)
*H01L 21/445* (2006.01)

(52) U.S. Cl.
CPC ..... *C25D 5/022* (2013.01)

(58) Field of Classification Search
CPC ..... C25D 5/022; C25D 11/022; C25D 11/26; C25D 11/32; C25D 11/34
USPC ..... 205/125, 124
See application file for complete search history.

(56) References Cited

U.S. PATENT DOCUMENTS

| | | | | |
|---|---|---|---|---|
| 4,763,229 | A | 8/1988 | Ohtuka et al. | 361/433 |
| 4,970,626 | A * | 11/1990 | Kakinoki et al. | 361/512 |
| 5,211,832 | A | 5/1993 | Cooper et al. | 205/322 |
| 7,144,768 | B2 | 12/2006 | Chung | 438/239 |
| 7,362,561 | B2 | 4/2008 | Takatani et al. | 361/528 |
| 2004/0251140 | A1 * | 12/2004 | Chung | 205/50 |
| 2006/0254922 | A1 * | 11/2006 | Brevnov et al. | 205/205 |
| 2011/0242778 | A1 * | 10/2011 | Theiss et al. | 361/760 |

OTHER PUBLICATIONS

Electrochemical Lithium Storage of Titanate and Titania Nanotubes and Nanorods H. Zhang, G. R. Li, L. P. An, T. Y. Yan, P. Gao and, and H. Y. Zhu The Journal of Physical Chemistry C 2007 111 (16), 6143-6148.*

A. Dey, et al., "Giant Dielectric Constant in Titania Nanoparticles Embedded in Conduction Polymer Matrix," *Journal of Nanoscience and Nanotechnology*, vol. 6, pp.1427-1436, 2006.

(Continued)

*Primary Examiner* — Luan Van
*Assistant Examiner* — Louis Rufo
(74) *Attorney, Agent, or Firm* — Pillsbury Winthrop Shaw Pittman LLP

(57) ABSTRACT

A method of manufacturing an electrode includes: providing a metal foil; depositing titanium metal on the metal foil; masking the titanium metal surface to control the density of sites where anodization will occur; and anodizing the Ti/metal foil so as to produce a nano-porous titania dielectric on the surface of the anode. The process may be on only one surface of the metal foil or on both sides simultaneously. The metal foil may be an aluminum foil. The porous titania dielectric may comprise titania nanotubes. An electrode structure may be fabricated using a linear process tool for reel-to-reel processing of a metal foil, the tool may include: a titanium deposition station for depositing a uniform thin film of titanium on the surface of the metal foil; a masking station for modifying the titanium surface to control the density of sites where anodization will occur; and an anodization station for transforming the Ti thin film into a porous titania dielectric film.

14 Claims, 9 Drawing Sheets

(56) References Cited

OTHER PUBLICATIONS

K. Nishio, et al., "Fabrication of Site-Controlled Tunnel Pits with High Aspect Ratios by Electrochemical Etching of A1 Using Masking Film," Electrochemical and Solid-State Letters, vol. 10, No. 10, pp. C60-C62.

D. Gong, et al., "Titanium Oxide Nanotube Arrays Prepared by Anodic Oxidation," *J. Mater. Res.*, vol. 16, No. 12, pp. 3331-3334, Dec. 2001.

W. -J. Lee, et al., "Titanium Dioxide Nanotube Arrays Fabricated by Anodizing Processes," *Journal of the Electrochemical Society*, vol. 153, No. 11, pp. B499-B505, 2006.

H.E. Prakasam, et al., "A New Benchmark for $TiO_2$ Nanotube Array Growth by Anodization," *J. Phys. Chem.*, 111, pp. 7235-7241, 2007.

Nichicon article available at: http://www.nichicon.co.jp/english/products/pdf/aluminum.pdf: last viewed Jun. 22, 2010.

K. Nishio, et al., "Control of Pitting Sites on A1 for Electrolytic Capacitors Using Patterned Masking Film," Electrochemical and Solid-State Letters, vol. 9, No. 9, pp. B39-B41, 2006.

* cited by examiner

HIGH PERFORMANCE TITANIA CAPACITOR WITH A SCALABLE PROCESSING METHOD

CROSS-REFERENCE TO RELATED APPLICATIONS

This application claims the benefit of U.S. Appl. No. 61/220,761 filed Jun. 26, 2009.

FIELD OF THE INVENTION

The present invention relates generally to energy storage devices, and more specifically to titania capacitors and scalable fabrication methods thereof.

BACKGROUND OF THE INVENTION

Capacitors store electrical energy in an electric field that forms between two electrodes separated by a dielectric material. The electrodes are most commonly configured as parallel plates with fixed separation. The capacitance, C, in Farads, is directly proportional to the electrode surface area, A, usable for charge separation and inversely proportional to the distance, d, between the two parallel electrodes, as shown in equation (1), where $\in$ is the permittivity of the dielectric.

$$C = \varepsilon \frac{A}{d} \tag{1}$$

The power rating, P, in Watts, of a capacitor cell is given by equation (2), where V is the potential difference between the two plates in volts and ESR is the equivalent series resistance in ohms.

$$P = \frac{1}{4}\frac{V^2}{(ESR)} \tag{2}$$

The energy rating, E, in Joules, of a capacitor cell is given by equation (3).

$$E = \frac{1}{2}CV^2 \tag{3}$$

To increase the capacitance, energy and power performance of a capacitor, one has to increase '$\in$', 'A', 'V' and/or decrease 'd'. However the value of 'd' is largely determined by the intrinsic properties of the dielectric material and device working voltage and cannot be varied significantly. (The thickness of the dielectric film is determined by the required working voltage and the strength of the dielectric material, measured in volts per meter. The dielectric strength is a measure of the maximum electric field that can exist in a dielectric without an electrical breakdown.) Therefore, when high capacitance, high power and energy performance are desired, it is necessary to combine the mutual benefits achieved with a high permittivity dielectric material, an increased effective surface area, and an enhanced dielectric strength.

Capacitors may use a bulk dielectric made from an insulating material. Alternatively, capacitors may have a microscopic dielectric layer, such as a metal oxide layer. Compared to bulk dielectric capacitors, this very thin dielectric allows for much more capacitance in the same unit volume.

In electrolytic capacitors, an electrolyte and a cathode foil together form the cathode, the second "plate" of the capacitor. Most commercial electrolytic capacitors are made with aluminum or tantalum anodes. There are also ceramic-based electrolytic capacitors, as described below.

Aluminum electrolytic capacitors are used as power supplies for automobiles, aircraft, space vehicles, computers, monitors, motherboards of personal computers and other electronics. There are two types of tantalum capacitors commercially available in the market; wet electrolytic capacitors which use sulfuric acid as the electrolyte and solid electrolytic capacitors which use $MnO_2$ as the solid electrolyte.

A typical aluminum electrolytic capacitor includes an anode foil and a cathode foil. Usually, the dielectric film is fabricated by anodizing high purity Al foil for high voltage applications in boric acid solutions. Anode, cathode and separator sheets are cut to a specific size, as per the design specification. A laminate is made up of the anode foil, the cathode foil which is opposed to the dielectric film of the anode foil, and a separator interposed between the anode and cathode foils. The laminate is wound to provide an element. The wound element is then immersed in an electrolyte, to saturate the separator, and housed in a metallic sheathed package with a cylindrical format. Here the electrolyte and the cathode foil together form the cathode. Ta and Al electrolytic capacitors fabricated using this general type of process are produced with capacitances up to 10 μF.

The capacitances of both Ta and Al based electrolytic capacitors are fairly similar. Al-based capacitors are cheaper than Ta-based capacitors on a $/farad basis, but Al-based capacitors produce current-spike noise in certain applications. On the other hand, tantalum-based capacitors are superior to Al-based capacitors in temperature and frequency characteristics and are preferred for circuits which need high stability characteristics. However, Ta metal is relatively rare and is subject to supply constraints and highly fluctuating prices. Clearly there is a need for electrolytic capacitors with performance comparable to Ta-based capacitors without having to rely on a metal that is subject to supply constraints and fluctuating prices.

Ceramic capacitors are based on the high dielectric constant rather than the electrode area. A ceramic capacitor is a capacitor constructed of alternating layers of metal and ceramic, with the ceramic material acting as the dielectric. Multilayer ceramic capacitors (MLCs) typically consist of approximately 100 alternating layers of electrode and ceramic sandwiched between two ceramic cover layers. MLCs are fabricated by screen-printing of electrode layers on ceramic layers and co-sintering of the laminate. Conventionally, the electrode material is Ag—Pd and the ceramic is $BaTiO_3$. MLCs are produced with capacitances up to tens of μF. MLCs are well suited for high frequency applications. However, MLCs have a complicated manufacturing process and that is relatively expensive.

Referring to equation (1), it may be appreciated that improvements in the performance of electrolytic capacitors are achieved by increasing the effective surface area, A, of the anode. For example, for an aluminum electrolytic capacitor this can be achieved by electrolytic etching of the aluminum substrate before anodization to form the dielectric layer at the aluminum anode surface. Further improvements in performance may be achieved by increasing $\in$ by using composite dielectric layers comprising relatively large $\in$ value compounds. For example, tantalum electrolytic capacitors with Ta metal anodes, polypyrrole cathodes and $Ta_2O_5$ dielectric layers have been fabricated. See M. Satoh, H. Ishikawa, K. Amane, E. Hassegawa, K. Yoshino, *Syn. Metals,* 71 (1995) 2259. Titania-polypyrrole nanocomposites may also be used to improve E. See J. Lin et al., Appl. Phys. Lett. 74, 2370 (1999).

Others have tried using alternate dielectric materials. For example, Chung in U.S. Pat. No. 7,144,768 describes the use of titanium and titanium alloy anodes with advantages in energy density, cost and material density when compared with tantalum. Chung states that the insulating and dielectric behavior of the titanium anode film—as measured by the leakage current and capacitance, for example—are uncertain and inconsistent and as a result, titanium and titanium alloys have generally not been used in capacitors. To overcome this limitation, Chung describes methods for controlling leakage current and capacitance in capacitors using titanium and titanium alloy anodes. Chung describes the following methods: (i) mechanical treatment, such as shot peening, of the surface to enhance the density of active sites; (ii) thermal treatment, such as quenching, to give the Ti anode an amorphous structure; and (iii) chemical treatment, such as doping the Ti or etching the Ti surface.

Having identified titanium and titanium alloys as potentially useful anode materials for capacitors there remains a need to develop a cost effective method for high volume manufacturing of titania capacitors. Furthermore, there remains a need to identify a titania capacitor structure compatible with such a cost effective method.

SUMMARY OF THE INVENTION

In general, embodiments of the present invention include methods to produce titania-based electrodes for incorporation into devices such as electrolytic capacitors with high capacitance, high power, high operating voltage, high energy density and long life. Embodiments of the present invention include high volume manufacturing methods for producing high quality dielectric films in a reel-to-reel process with favorable process speeds, uniformity and control. Electrodes compatible with these high volume manufacturing processes may comprise an aluminum foil covered on at least one surface with a titania dielectric. The electrodes may be used in capacitors, electrolytic capacitors, and other such short-duration energy storage devices.

According to aspects of this invention, a first embodiment of a method of manufacturing an electrode includes: providing a metal foil; etching the metal foil to increase the surface area; depositing titanium metal on the etched metal foil; pretreating the Ti/metal foil; and anodizing the Ti/metal foil so as to produce a titania dielectric on the surface of the anode. Wherein the pretreatment includes one or more of the following: (i) mechanical treatment, such as shot peening, of the Ti metal surface; (ii) thermal treatment, such as quenching; and (iii) chemical treatment, such as doping the Ti or etching the Ti surface; and wherein the pretreatment improves the dielectric strength of the titania film subsequently formed by anodization. The process may be limited to only one surface of the metal foil. Alternatively, the metal foil may be processed on both sides. The metal foil may be an aluminum foil.

According to further aspects of the invention, a second embodiment of a method of manufacturing an electrode includes: providing a metal foil; depositing titanium metal on the metal foil; masking the titanium metal surface to control the density of sites where anodization will occur; and anodizing the Ti/metal foil so as to produce a nano-porous titania dielectric on the surface of the anode. The process may be limited to only one surface of the metal foil. Alternatively, the metal foil may be processed on both sides. The metal foil may be an aluminum foil. The porous titania dielectric may comprise titania nanotubes. Further embodiments may also include pretreating the Ti metal for improving the dielectric strength of the titania film subsequently formed by anodization.

According to embodiments of the invention, a linear process tool for reel-to-reel processing of a metal foil to form an electrode structure may include: a foil etching station for increasing the surface area of the metal foil; a titanium deposition station for depositing a uniform thin film of titanium on the surface of the etched metal foil; a pretreatment station; and an anodization station. Wherein the pretreatment station provides one or more of the following: (i) mechanical treatment, such as shot peening, of the Ti metal surface; (ii) thermal treatment, such as quenching; and (iii) chemical treatment, such as doping the Ti or etching the Ti surface; and wherein the pretreatment improves the dielectric strength of the titania film subsequently formed at the anodization station.

According to further embodiments of the invention, a linear process tool for reel-to-reel processing of a metal foil to form an electrode structure may include: a titanium deposition station for depositing a uniform thin film of titanium on the surface of the metal foil; a masking station for modifying the titanium surface to control the density of sites where anodization will occur; and an anodization station for transforming the Ti thin film into a porous titania dielectric film. The porous titania thin film may comprise titania nanotubes. Further embodiments may also include stations for pretreating the Ti metal prior to anodization, mask stripping and/or anodization of the stripped Ti metal surface.

The present invention includes the electrode structures corresponding to the aforementioned first and second methods of manufacturing, and electrolytic capacitor structures incorporating these electrode structures.

BRIEF DESCRIPTION OF THE DRAWINGS

These and other aspects and features of the present invention will become apparent to those ordinarily skilled in the art upon review of the following description of specific embodiments of the invention in conjunction with the accompanying figures, wherein.

DETAILED DESCRIPTION

The present invention will now be described in detail with reference to the drawings, which are provided as illustrative examples of the invention so as to enable those skilled in the art to practice the invention. Notably, the figures and examples below are not meant to limit the scope of the present invention to a single embodiment, but other embodiments are possible by way of interchange of some or all of the described or illustrated elements. Moreover, where certain elements of the present invention can be partially or fully implemented using known components, only those portions of such known components that are necessary for an understanding of the present invention will be described, and detailed descriptions of other portions of such known components will be omitted so as not to obscure the invention. In the present specification, an embodiment showing a singular component should not be considered limiting; rather, the invention is intended to encompass other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

In general, embodiments of the present invention include methods to produce titania-based electrodes, for use in devices such as capacitors with high operating voltage, high capacitance, high energy density and long life. Embodiments of the present invention include high volume manufacturing methods for producing high quality dielectric films in a reel-to-reel process with favorable process speeds, uniformity and control. The present invention includes electrode structures fabricated using these methods. Some embodiments of these titania-based electrodes may be integrated into electrolytic capacitors suitable to serve capacitor markets currently served by tantalum and aluminum electrolytic capacitors. The examples provided herein are directed to manufacturing electrolytic capacitors; however, the concepts are applicable to electrodes for other devices, for example anodes for capacitors (other than electrolytic), ultracapacitors (also referred as supercapacitors), Li-ion batteries.

Figure 1:
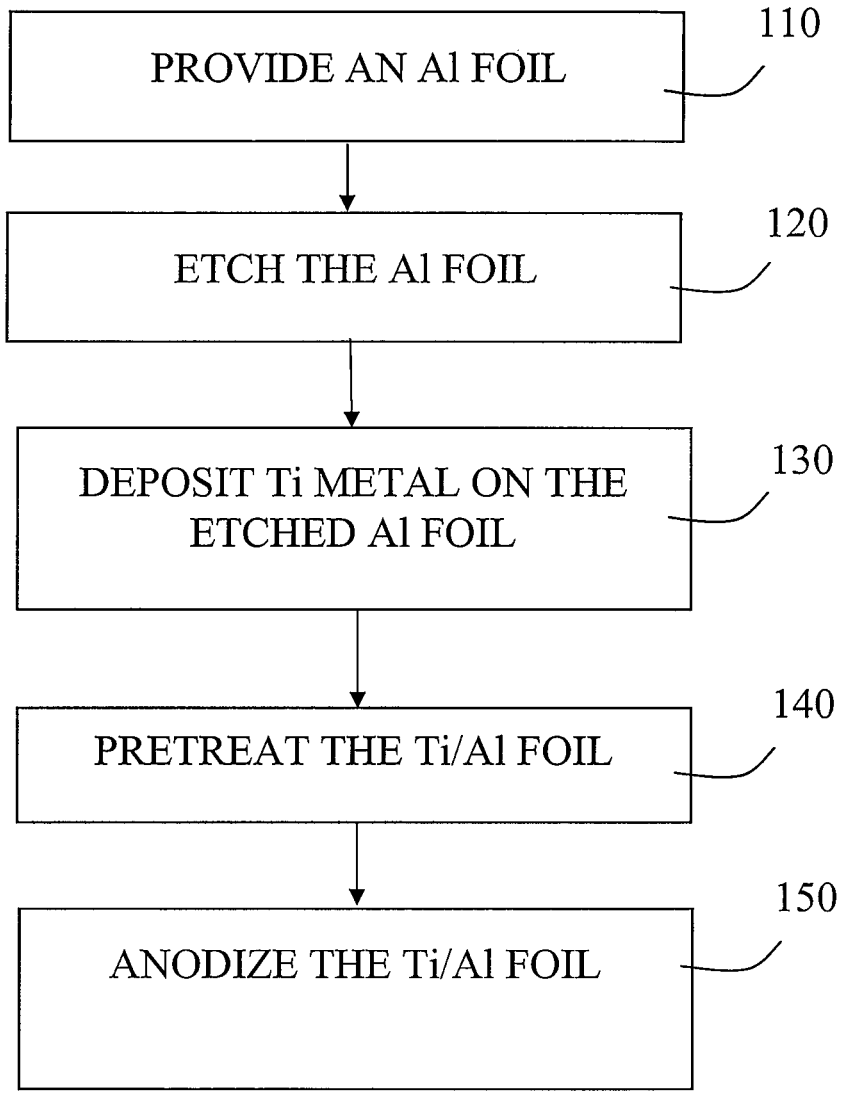
FIG. 1 is a flow chart, according to a first embodiment of the present invention.

FIG. 1 shows a first embodiment of a basic process flow for manufacturing a titania-based anode, including: providing an aluminum foil (110); etching the aluminum foil to increase the surface area (120); depositing titanium metal (or doped titanium metal, where the doping may improve the dielectric properties of the subsequently anodized metal) on the etched aluminum foil (130); pretreating the Ti/Al foil (140); and anodizing the Ti/Al foil so as to produce a titania dielectric on the surface of the anode (150). The process may be limited to only one surface of the Al foil. Alternatively, the Al foil may be processed on both sides. For example, the processes may be carried out in equipment that permits simultaneous processing of both sides of the Al foil. Furthermore, the metal foil is not restricted to being an aluminum foil—other metals may also be used, including copper or titanium. However, an aluminum foil is attractive for its low cost, availability in long lengths (kilometers) and variety of widths and desired thickness and electrical properties.

The aluminum foil may be provided with an etched surface, in which foil etching 120 is nor required. Also, the etching step may be skipped, in which case Ti metal is deposited onto a metal foil with a planar surface. The Ti deposition 130 can be a sputtering/physical vapor deposition process, chemical vapor deposition (CVD), or other deposition process. The Ti layer uniformity, thickness, phase, composition and microstructure are controlled using the known art applicable to PVD, sputtering, webtools, etc. The Ti deposition may be conducted in a high speed roll to roll process tool, referred to as a web tool, such as web tools manufactured and sold by Applied Materials. The pretreatment may be one or more of (i) mechanical treatment, such as shot peening, of the Ti metal surface; (ii) thermal treatment, such as quenching; and (iii) chemical treatment, such as doping the Ti or etching the Ti surface; wherein the pretreatment improves the dielectric strength of the titania film subsequently formed by anodization. The anodization process may be conducted in a tool such as Applied Material's Desica™ tool.

An electrode was fabricated following the process of FIG. 1. 500 nm Ti layers were deposited on both sides of a planar high purity Al foil. The mechanical, thermal, and chemical treatment processes described above were then applied to the Ti/Al/Ti foil. The measured capacitance of the anodized film formed at 10 V was 1.37 μF at 120.11 Hz, which is calculated to a capacitance density of 0.59 $\mu F/cm^2$. This capacitance density is 1.69 to 1.48 times higher than that of anodic $Al_2O_3$ (~0.35-0.40 $\mu F/cm^2$) formed at the same anodization voltage of 10 V. Leakage current after three minutes was measured for the anodized film at operating voltages of 4 to 8 V. The results ranged from 0.16 to 0.38 $\mu A/cm^2$, which is comparable to or better than that of tantalum films. These results are representative, and further improvements are expected with some of the embodiments described herein.

Figure 2:
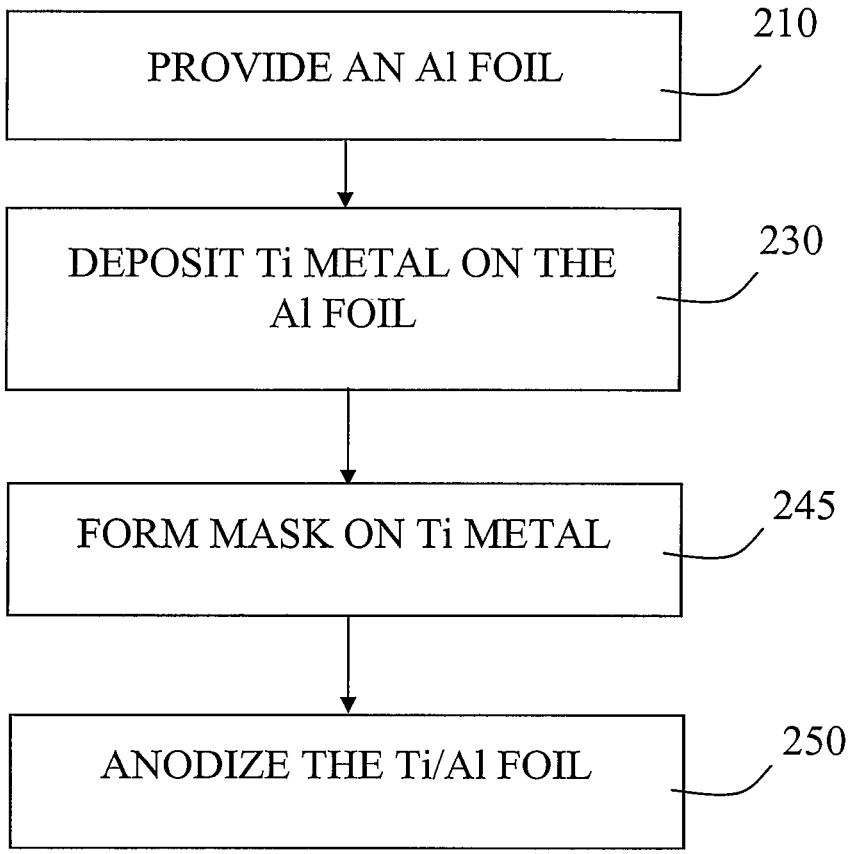
FIG. 2 is a flow chart, according to a second embodiment of the present invention.

FIG. 2 shows a second embodiment of the basic process flow for manufacturing a titania-based anode, including: providing an aluminum foil (210); depositing titanium metal (or doped titanium metal, where the doping may improve the dielectric properties of the subsequently anodized metal) on the aluminum foil (230); masking the titanium metal surface to control the density of sites where anodization will occur (245); and anodizing the Ti/Al foil so as to produce a nanoporous titania dielectric on the surface of the anode (250). The process may be limited to only one surface of the Al foil. Alternatively, the Al foil may be processed on both sides. For example, the processes may be carried out in equipment that permits simultaneous processing of both sides of the Al foil. Furthermore, the metal foil is not restricted to being an aluminum foil—other metals may also be used, including copper and titanium. However, an aluminum foil is attractive for its low cost, availability in long lengths (kilometers), variety of widths, desired thickness and electrical properties. Note that mask removal and anodization of the stripped Ti metal surfaces may also be needed, and are described in more detail below with reference to FIGS. 7*a*-7*d* and 8.

The Ti deposition 230 can be a sputtering/physical vapor deposition process, CVD, or other deposition process. The Ti layer uniformity, thickness, phase, composition and microstructure are controlled using the known art applicable to PVD, sputtering, webtools, etc. The Ti deposition may be conducted in a high speed roll to roll process tool, referred to as a web tool, such as web tools manufactured and sold by Applied Materials. The titanium coated Al foil is anodized to form a porous titania dielectric layer using methods known to those skilled in the art. For example, see Woo-Jin Lee et. al., Journal of The Electrochemical Society, 153, 11, B499 [2006] and H. E. Prakasam et. al., Journal of Phys Chem C 111, 7235 [2007]. Applied Material's Desica™ tool platform may be used as a basis for a tool to form the porous titania dielectric layer following the aforementioned anodization processes.

The masking process (245) and the anodization process (250) are known processes which have been adapted for this particular application, as described below. Processes for the formation of titania nanotube structures by anodization have been reported in the literature. See D. Gong, et.al., Titanium Oxide Nanotube Arrays Prepared by Anodic Oxidation, J.

Mater. Res., Vol. 16, No. 12, December 2001. However, the nanotube arrays so formed will have limited active interfacial area between the conductor (Ti) and Dielectric ($TiO_2$) layers. In some embodiments of the current invention, titania tubular structures with high interfacial area between Ti and $TiO_2$ are beneficial in enhancing the capacitance and energy ratings of the dielectric layers and the capacitors, as follows from Eq. 1 and Eq. 3. Fabrication of high Ti/$TiO_2$ interface area titania tubular structures, as shown in FIG. 6*b*, may be obtained through the use of processes similar to those previously published for making aluminum electrolytic capacitors making use of masking to obtain anodized patterned structures. See K. Nishio, et. al., Control of Pitting Sites on Al for Electrolytic Capacitors Using Patterned Masking Film, Electrochemical and Solid-State Letters, 9 (9) B39-B41 (2006). Further details of the fabrication methods for high Ti/$TiO_2$ interface area titania tubular structures are described in more detail below.

An electrode was fabricated using the process of FIG. 2. Foils with 200 nm and 500 nm thick Ti layers deposited on both sides of planar Al foils were prepared. The samples were anodized to form titania nanotubular structures on the Al foil using methods similar to those published in the literature, cited above. The resulting titania-based anode is a nominally defect-free, high surface area nano-structured titania on a conducting metal foil.

In both the first and second embodiments of methods of the present invention the goal is to grow defect-free titania thin films of controllable thickness—typically a few hundred nanometers thick—with properties which may include high dielectric constant, high break down potential and low direct current leakage.

Figure 3:
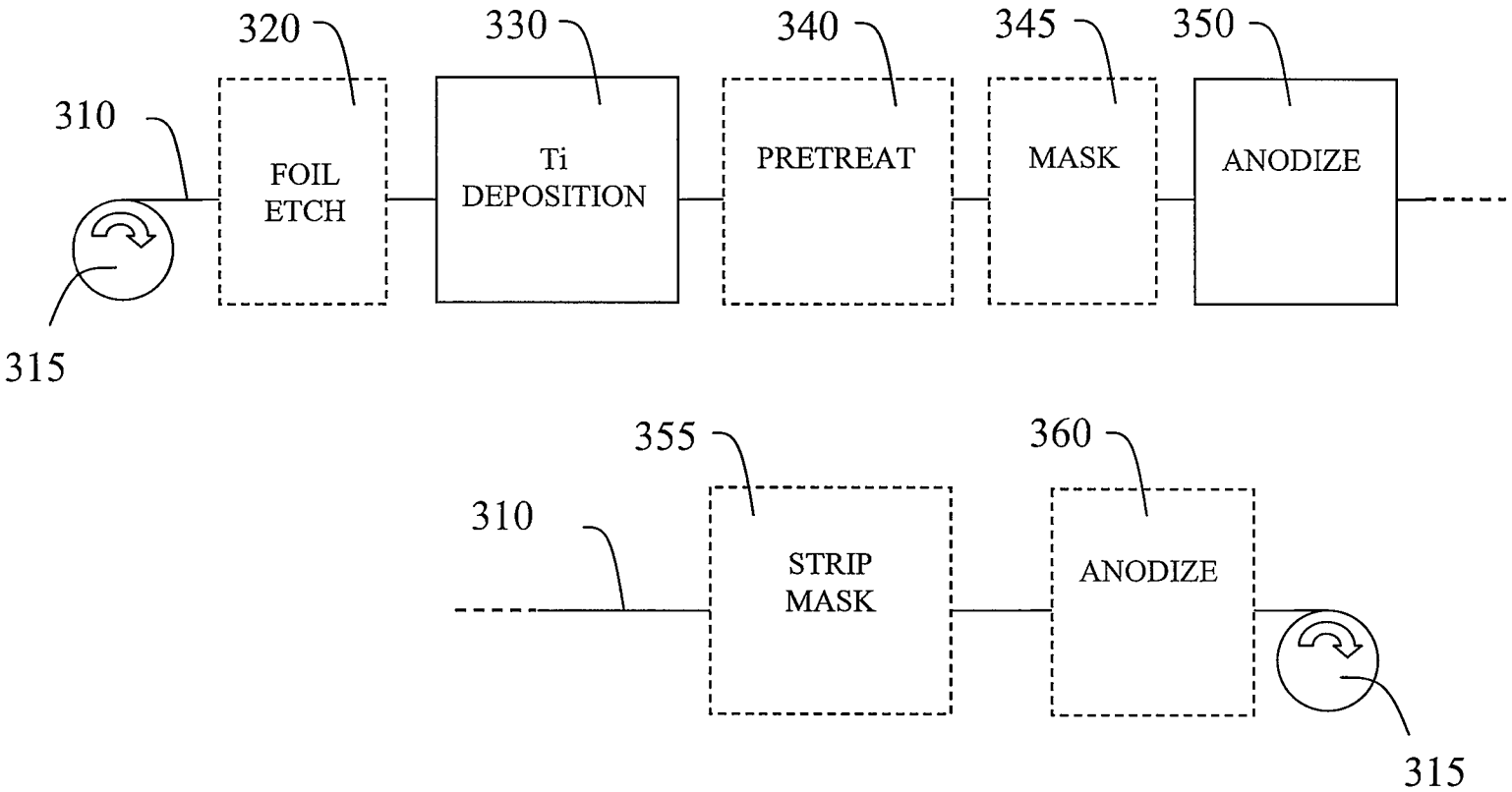
FIG. 3 is a representation of a process tool, according to some embodiments of the present invention.

FIG. 3 shows a representation of an embodiment of a web-processing system according to the present invention, for manufacturing titania-based anodes. A metal foil 310, such as an Al foil, is transferred from reel-to-reel 315 through a linear arrangement of processing tools 320-350. The processing tools may include: a tool for etching the metal foil (320); a tool for depositing titanium metal on the metal foil (330); a tool for pretreating the Ti/metal foil (340); a tool for masking the titanium metal surface to control the density of sites where anodization will occur (345); and a tool for anodizing the Ti/metal foil (350). The tools may be configured for processing of only one surface of the metal foil. Alternatively, the tools may be configured for processing both sides of the metal foil simultaneously. Depending on the process method being followed, the choice of tools will differ, as is apparent from the process flows shown in FIGS. 1, 2 and 8. For example, when following the process flow of FIG. 2, the foil etch tool 320 and the pretreatment tool 340 will not be needed. Furthermore, the specification of the processes in the tools will vary between process flows. For example, the anodization tool 350 is required to form a dense titania dielectric film in the process flow of FIG. 1 and a porous titania dielectric film in the process flow of FIG. 2. Furthermore, when following the process described with reference to FIG. 8, tools for stripping the masking material (355) and anodization of the surface of the unmasked Ti metal (360) may be added after the anodization tool 350.

The foil etch tool 320 is an etch tool suitable for this process that will be familiar to those skilled in the art. The Ti deposition tool 330 can be a sputtering/physical vapor deposition tool, a CVD tool, or other deposition tool. The Ti layer uniformity, thickness, phase, composition and microstructure are controlled using the known art applicable to PVD, sputtering, webtools, etc. The Ti deposition may be conducted in a high speed roll to roll process tool, referred to as a web tool, such as web tools manufactured and sold by Applied Materials. For example the Multimet™ production metallization tool. The pretreatment tool 340 may be a tool configured to provide one or more of (i) mechanical treatment, such as shot peening, of the Ti metal surface; (ii) thermal treatment, such as quenching; and (iii) chemical treatment, such as doping the Ti or etching the Ti surface; wherein the pretreatment improves the dielectric strength of the titania film subsequently formed by anodization. The masking tool 345 is a masking tool suitable for processing the substrates according to the masking process described above. The anodization process may be conducted in an anodization tool 350 such as a tool based on Applied Material's Desica™ tool. The stripping tool 355 may be a standard chemical or mechanical stripping tool. The anodization tool 360 may be configured very similarly to the anodization tool 350.

Figure 4A:
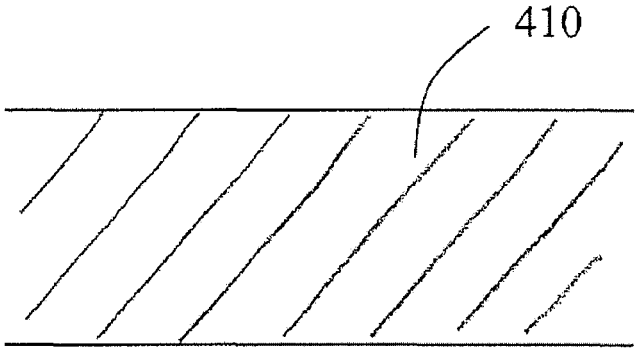
FIGS. 4*a* to 4*c* illustrate a capacitor anode fabrication process, according to the first embodiment of the present invention.
Figure 4B:
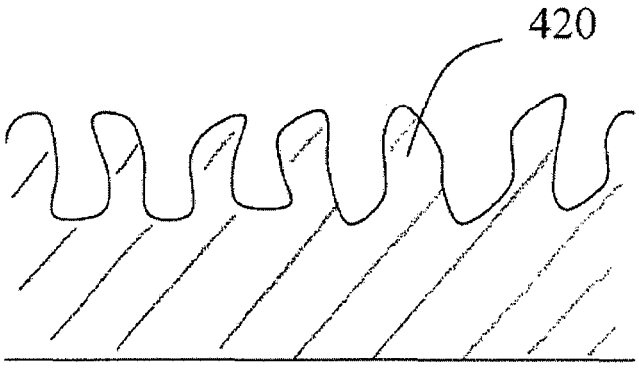
Figure 4C:
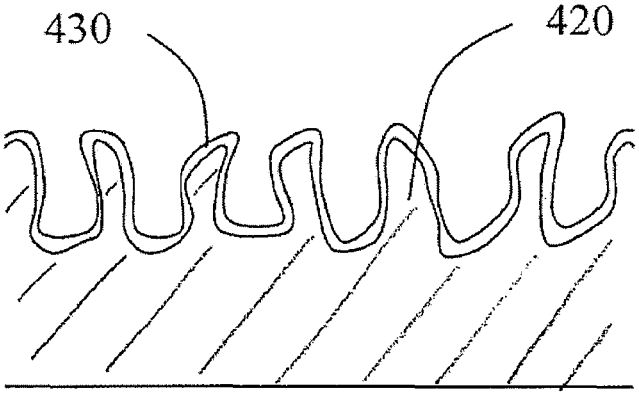

FIGS. 4*a* through 4*c* show cross-sections of an anode structure according to embodiments of the present invention, wherein the anode has been processed on only one side according to the process steps 110, 120 and 130 of the process flow of FIG. 1. FIG. 4*a* shows a metal film 410, such as an Al film. FIG. 4*b* shows an etched metal film 420, processed according to etching step 110 of FIG. 1. FIG. 4*c* shows the etched film 420 with a layer of Ti metal 430 deposited on its surface, processed according to step 130 of FIG. 1. The increased surface area of the anode is clearly seen in FIG. 4*c*.

Figure 5:
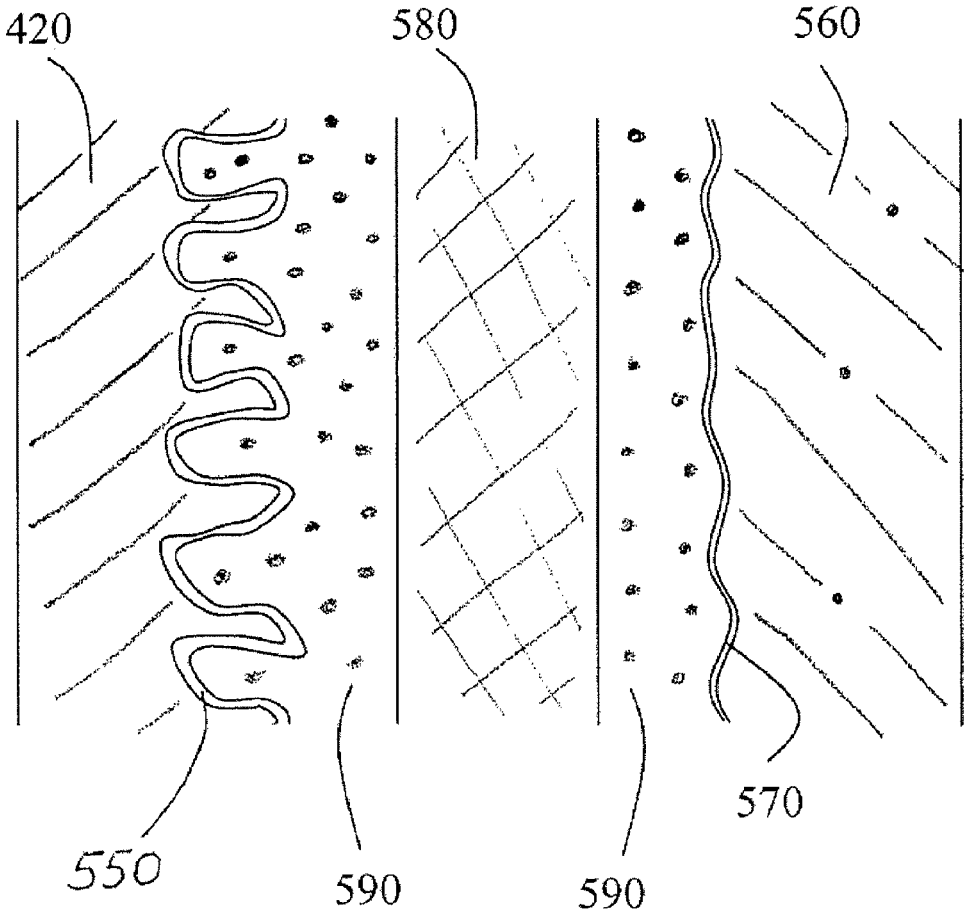
FIG. 5 is a cross-sectional representation of an electrolytic capacitor, according to some embodiments of the present invention.

FIG. 5 shows a cross-sectional representation of an electrolytic capacitor, according to some embodiments of the present invention. The anode comprises an etched Al foil 420 with a dielectric titania thin film 550 on its surface. The capacitor has a second electrode 560, which may be an Al foil. The second electrode 560 has a thin dielectric 570 on its surface. Dielectric 570 is much thinner than 550, leading to a much larger capacitance. Consequently, the performance of the capacitor is dominated by the properties of 550. A separator 580, saturated with an electrolyte 590 is sandwiched between the anode and the second electrode. Note that the electrolyte 590 is the cathode of the electrolytic capacitor, and that the electrolyte 590 readily infiltrates the pores on the anode surface, making electrical contact to the entire anode surface area. Standard processes known in the art are used to form capacitors using anodes fabricated using the processes of the present invention.

Figure 6A:
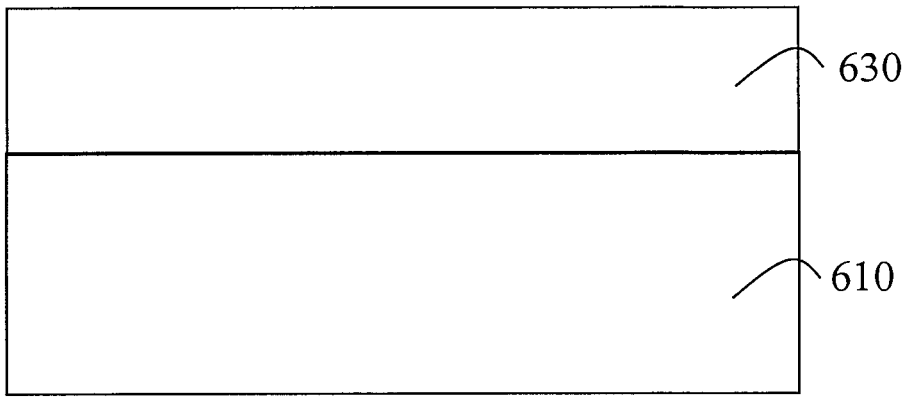
FIGS. 6*a* to 6*b* illustrate a capacitor anode fabrication process, according to the second embodiment of the present invention.
Figure 6B:
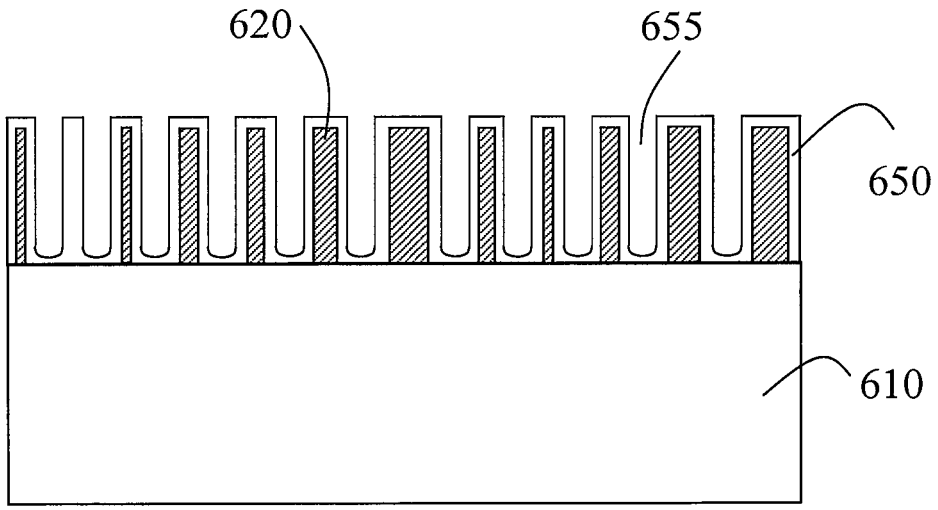

FIGS. 6*a* and 6*b* show cross-sections of an anode structure according to embodiments of the present invention, wherein the anode has been processed on only one side according to the process steps of the process flow of FIG. 2. FIG. 6*a* shows a metal film 610, such as an Al film, covered by a Ti metal film 630. FIG. 6*b* shows an anode structure, processed according to anodization step 250 of FIG. 2, with pores 655 and an anodized titania dielectric layer 650 covering remaining Ti metal 620. The increased surface area of the anode is clearly seen in FIG. 6*b*.

According to further embodiments of the present invention, a similar process to that described above could be applied to $BaSrTiO_3$ capacitors. This may be achieved by replacing the Ti with Ba, Sr, and Ti in the PVD/CVD deposition step and modify the anodization chemistry accordingly.

Figure 7A:
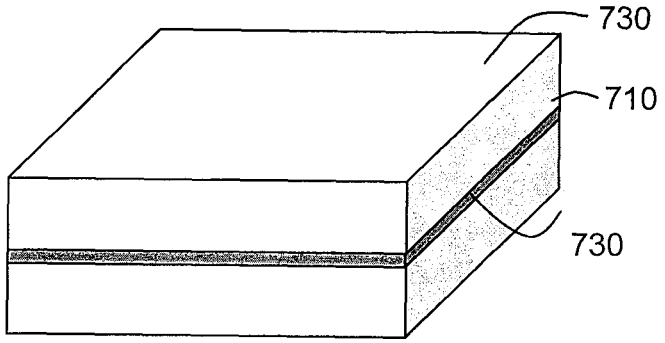
FIGS. 7*a* to 7*d* illustrate a capacitor anode fabrication process, according to a third embodiment of the present invention.
Figure 7B:
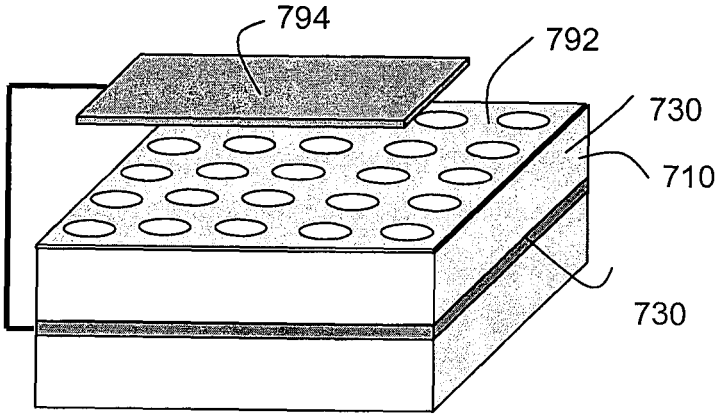
Figure 7C:
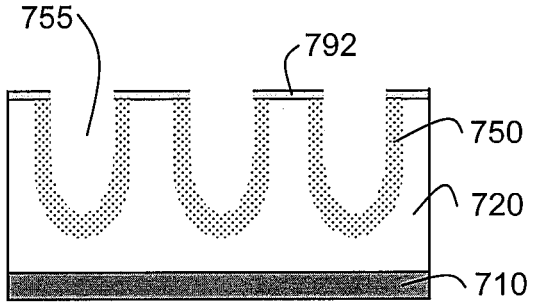
Figure 7D:
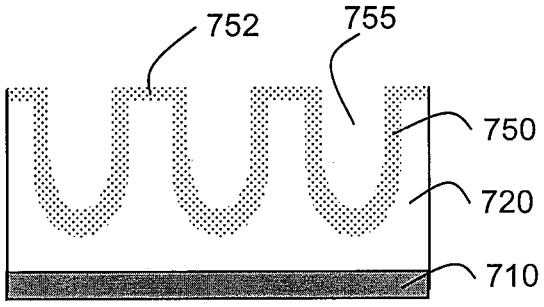

According to a third embodiment of the present invention, pretreatment of the Ti films may be incorporated into the process flow of FIG. 2. An example of such a process is illustrated in FIGS. 7*a*-7*d*. First, Ti thin film(s) 730 are deposited on either one side or both sides of Al or other metal or metal alloy foil 710, as shown in FIG. 7*a*. The Ti film thickness ranges from 0.05 μm to 1000 μm, depending on the specific application. These Ti films 730 are treated by one or more of: (i) mechanical treatment, such as shot peening, of the Ti metal surface; (ii) thermal treatment, such as quenching; and (iii) chemical treatment, such as doping the Ti or etching the Ti surface. The treated Ti metal surface(s) are covered by masking materials 792 with openings of controlled diameter and pattern/distribution in a roll to roll process. The openings may be tens or hundreds of nanometers in diameter, or larger. The masking materials 792 may be poly(chloroprene) rubber or other chemicals which are inert to the electrolyte solution under electric field. Electrical field is then applied as shown in FIG. 7*b* to anodize the Ti metal film 730 into a structure with high interfacial area. The cathode 794 may be a platinum thin film/mesh or other metal or metal alloy which is inert to the electrolyte under electric field. This anodization process is stopped when the desired pore etch depth is achieved. The anodized areas may contain either single pores 755, as indicated in FIG. 7*c*, or may contain multiple pores. Pore diameters typically are in the range of 1 to 200 nanometers, and pore depth can reach the Ti metal film thickness (typically in the range of 0.05 μm to 1000 μm); consequently the aspect ratio for the pores—depth to diameter—generally exceeds 5 and can be very large—$1\times10^6$, for example. A cross-section of the resultant porous structure is shown in FIG. 7*c*, which shows remaining Ti metal 720 and a $TiO_2$ layer 750 over the etched surface of the Ti metal. The thickness of layer 750 is roughly one tenth the pore diameter, although this thickness is a balance between capacitance (higher for thinner layer) and dielectric strength (better for thicker films) and may be need to be adjusted to suit the requirements of particular applications. A chemical or mechanical process is used to remove the mask materials 792, followed by a short anodization process which converts the Ti metal which was covered by the mask 792 into a high quality $TiO_2$ layer 752 as shown in the cross-section in FIG. 7*d*. Note that the specific process steps described above for the masking and anodization may also be applied to the process of FIG. 2.

Figure 8:
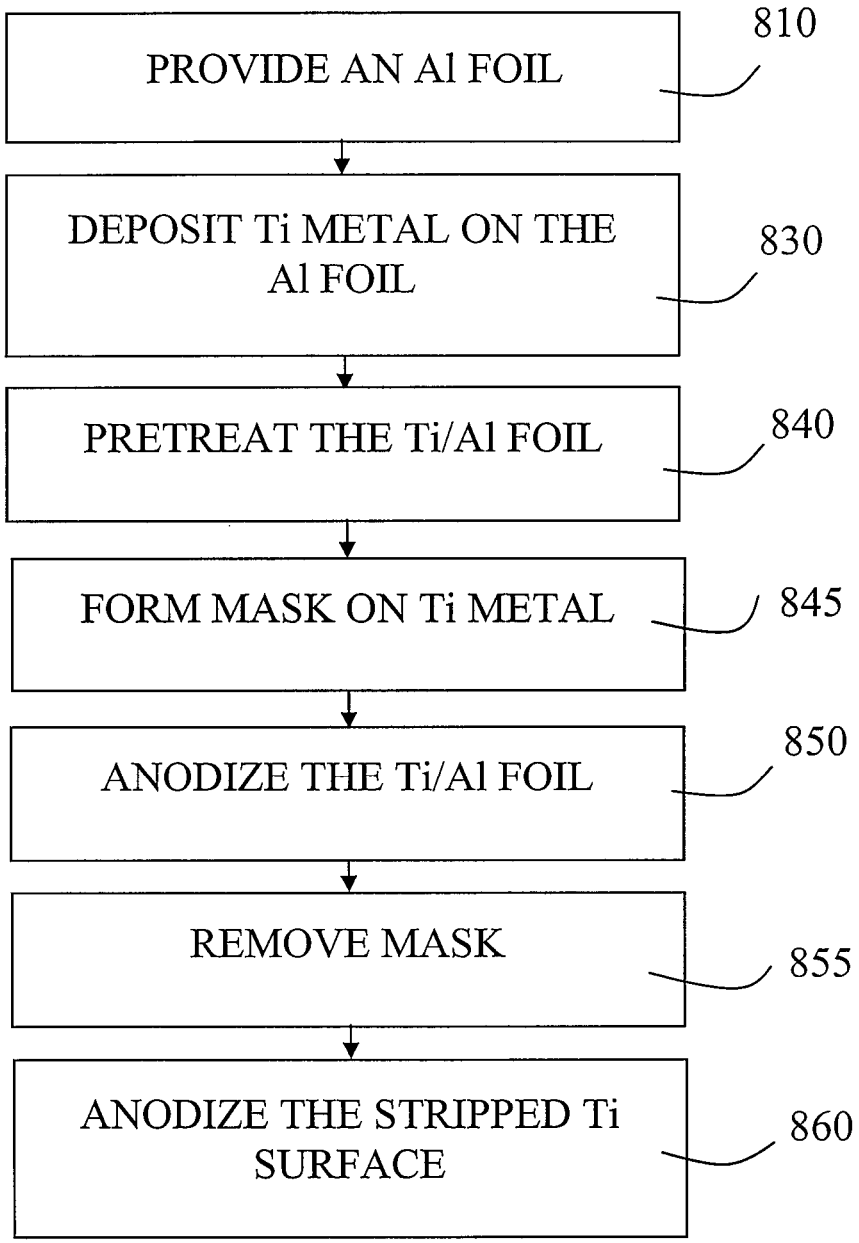
FIG. 8 is a flow chart, according to a third embodiment of the present invention.

The process of FIGS. 7*a*-7*d*, as described above, is summarized in the process flow of FIG. 8. FIG. 8 shows a third embodiment of the basic process flow for manufacturing a titania-based anode, including: providing an aluminum foil (810); depositing titanium metal (or doped titanium metal, where the doping may improve the dielectric properties of the subsequently anodized metal) on the aluminum foil (830); pretreating the Ti/Al foil (840); masking the titanium metal surface to control the density of sites where anodization will occur (845); anodizing the Ti/Al foil so as to produce a nano-porous titania dielectric on the surface of the anode (850); mask removal (855); and anodization of the stripped Ti metal surfaces (860). The pretreatment may be one or more of (i) mechanical treatment, such as shot peening, of the Ti metal surface; (ii) thermal treatment, such as quenching; and (iii) chemical treatment, such as doping the Ti or etching the Ti surface; wherein the pretreatment improves the dielectric strength of the titania film subsequently formed by anodization. The process may be limited to only one surface of the Al foil. Alternatively, the Al foil may be processed on both sides. For example, the processes may be carried out in equipment that permits simultaneous processing of both sides of the Al foil. Furthermore, the metal foil is not restricted to being an aluminum foil—other metals may also be used, including copper and titanium. However, an aluminum foil is attractive for its low cost, availability in long lengths (kilometers), variety of widths, desired thickness and electrical properties.

Although the present invention has been particularly described with reference to embodiments thereof, it should be readily apparent to those of ordinary skill in the art that changes and modifications in the form and details may be made without departing from the spirit and scope of the invention.

What is claimed is:

1. A method of manufacturing an electrode comprising:

providing a metal foil;

depositing titanium metal on said metal foil;

masking the surface of said titanium metal with a masking material to protect a first portion of the surface of said titanium metal, wherein a second portion of the surface of said titanium metal is unprotected by said masking material; and anodizing said second portion of the surface of said titanium metal to form a high aspect ratio nano-porous titania dielectric on the surface of said electrode;

wherein said anodizing includes causing electrolyte solution to contact said titanium metal and applying an electric field to said electrolyte solution contacting said titanium metal, and wherein said anodizing further includes etching pores in said titanium meal, said pores having an aspect ratio of depth to diameter greater than 5, and wherein the diameter of said pores is between 1 and 200 nanometers, and wherein a layer of titanium dioxide covers the surface of said pores, the thickness of said layer of titanium dioxide being approximately one tenth of the diameter of said pores.

2. The method as in claim 1, wherein said metal foil is aluminum foil.

3. The method as in claim 1, wherein said depositing titanium metal is on both sides of said metal foil.

4. The method as in claim 1, wherein said nano-porous titania dielectric includes titania nanotubes.

5. The method as in claim 1, further comprising, before said masking, pretreating said titanium metal to improve the dielectric strength of said nano-porous titania dielectric, subsequently formed by said anodizing.

6. The method as in claim 5, wherein said pretreating includes mechanical treatment of said titanium metal.

7. The method as in claim 5, wherein said pretreating includes thermal treatment of said titanium metal.

8. The method as in claim 5, wherein said pretreating includes chemical treatment of said titanium metal.

9. The method as in claim 1, further comprising:

stripping said masking material; and anodizing said first portion of the surface of said titanium metal to form a titanium dioxide layer.

10. The method as in claim 1, wherein said masking is a roll to roll application of said masking material to the surface of said titanium metal on said metal foil.

11. The method as in claim 1, wherein said second portion of the surface of said titanium metal comprises a multiplicity of areas, each of said multiplicity of areas comprising only one of said pores after said anodizing.

12. The method as in claim 1, wherein said second portion of the surface of said titanium metal comprises a multiplicity of areas, each of said multiplicity of areas comprising a plurality of said pores after said anodizing.

13. The method as in claim 1, wherein the depth of said pores is equal to the thickness of said titanium metal.

14. The method as in claim 1, wherein said titanium metal is undoped.

* * * * *

UNITED STATES PATENT AND TRADEMARK OFFICE

CERTIFICATE OF CORRECTION

PATENT NO. : 9,023,186 B1
APPLICATION NO. : 12/824094
DATED : May 5, 2015
INVENTOR(S) : Patibandla et al.

It is certified that error appears in the above-identified patent and that said Letters Patent is hereby corrected as shown below:

In the Specification

In Column 3, Line 4, delete "improve E." and insert -- improve ε. --, therefor.

Signed and Sealed this
Third Day of November, 2015

Michelle K. Lee

Michelle K. Lee
*Director of the United States Patent and Trademark Office*